United States Patent [19]

Braun et al.

[11] Patent Number: 4,947,189

[45] Date of Patent: Aug. 7, 1990

[54] BUBBLE JET PRINT HEAD HAVING IMPROVED RESISTIVE HEATER AND ELECTRODE CONSTRUCTION

[75] Inventors: Hilarion Braun, Xenia; Michael F. Baumer, Dayton, both of Ohio

[73] Assignee: Eastman Kodak Company, Rochester, N.Y.

[21] Appl. No.: 350,887

[22] Filed: May 12, 1989

[51] Int. Cl.[5] ..... B41J 2/05

[52] U.S. Cl. ..... 346/140 R

[58] Field of Search ..... 346/140, 1.1, 76 PH; 219/216, 543; 338/333, 308, 309

[56] References Cited

U.S. PATENT DOCUMENTS

| | | | |
|---|---|---|---|
| 4,204,107 | 5/1980 | Ohkubo et al. | 219/216 |
| 4,339,762 | 7/1982 | Shirato et al. | 346/140 |
| 4,345,262 | 8/1982 | Shirato | 346/140 |
| 4,413,170 | 11/1983 | Val et al. | 219/216 |
| 4,514,741 | 4/1985 | Meyer | 346/140 |
| 4,590,489 | 5/1986 | Isumura et al. | 346/76 |
| 4,602,261 | 7/1986 | Matsuda et al. | 346/140 |
| 4,679,056 | 7/1987 | Kobayashi et al. | 346/76 |
| 4,719,478 | 1/1988 | Lachihara et al. | 346/140 |
| 4,725,859 | 2/1988 | Shibata | 346/140 |
| 4,792,818 | 12/1988 | Eldridge | 346/140 |

FOREIGN PATENT DOCUMENTS

| | | |
|---|---|---|
| 59-230774 | 12/1984 | Japan . |
| 61-152467 | 7/1986 | Japan . |
| 61-241163 | 10/1986 | Japan . |
| 61-272167 | 12/1986 | Japan . |
| 62-71663 | 4/1987 | Japan . |

*Primary Examiner*—Joseph W. Hartary
*Attorney, Agent, or Firm*—John D. Husser

[57] ABSTRACT

An improved heater/electrode construction for a bubble jet print head of the kind having discrete ink heater elements formed of electrically resistive material and a plurality of address electrode pairs formed of electrically conductive material and electrically contacting opposing edge regions of respective heater elements. The heater element resistance increases from its center outward and the electrode ends are spaced from the bubble formation region to provide, in a drop ejection condition, a flat slope temperature profile along the current flow path through the bubble formation zone.

7 Claims, 3 Drawing Sheets

FIG. 1
(PRIOR ART)
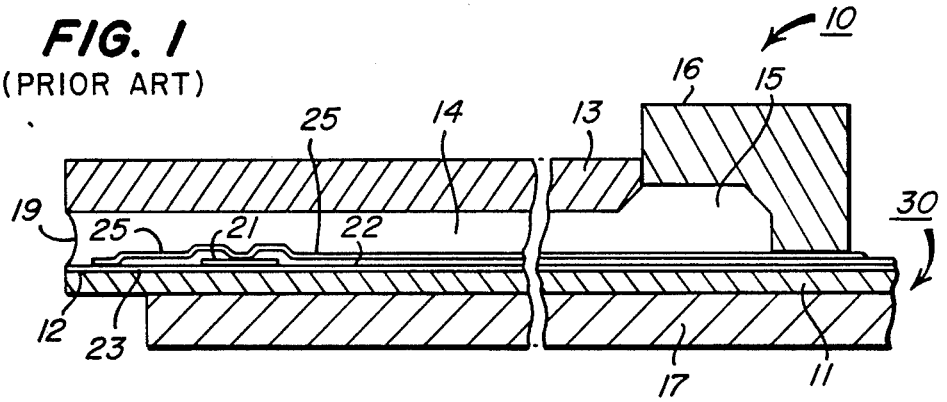
FIG. 2
(PRIOR ART)
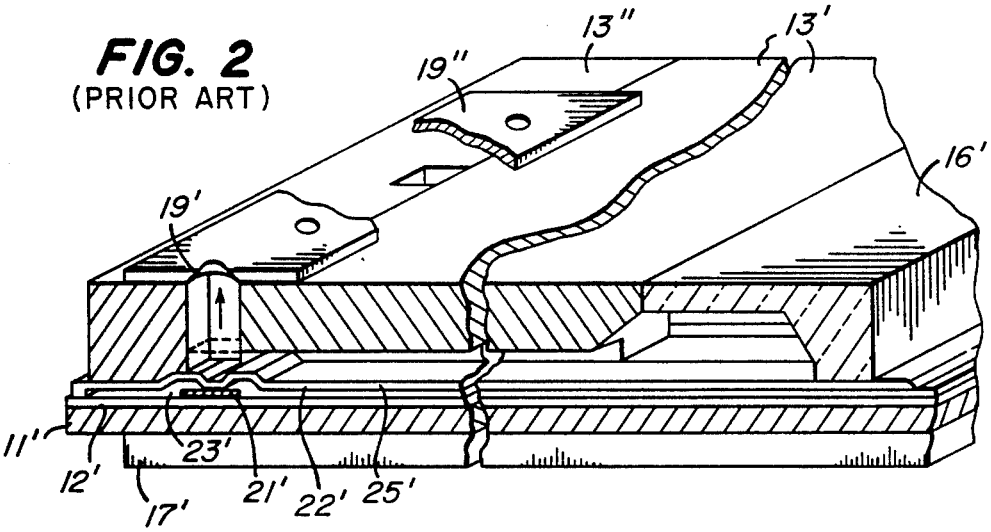
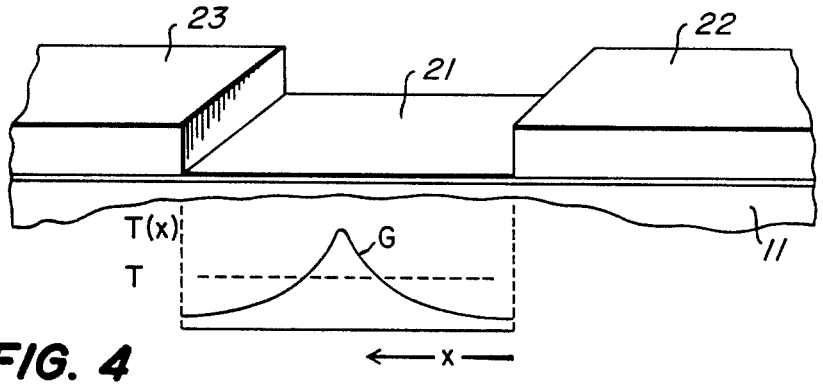
FIG. 4
(PRIOR ART)

FIG. 3
(PRIOR ART)
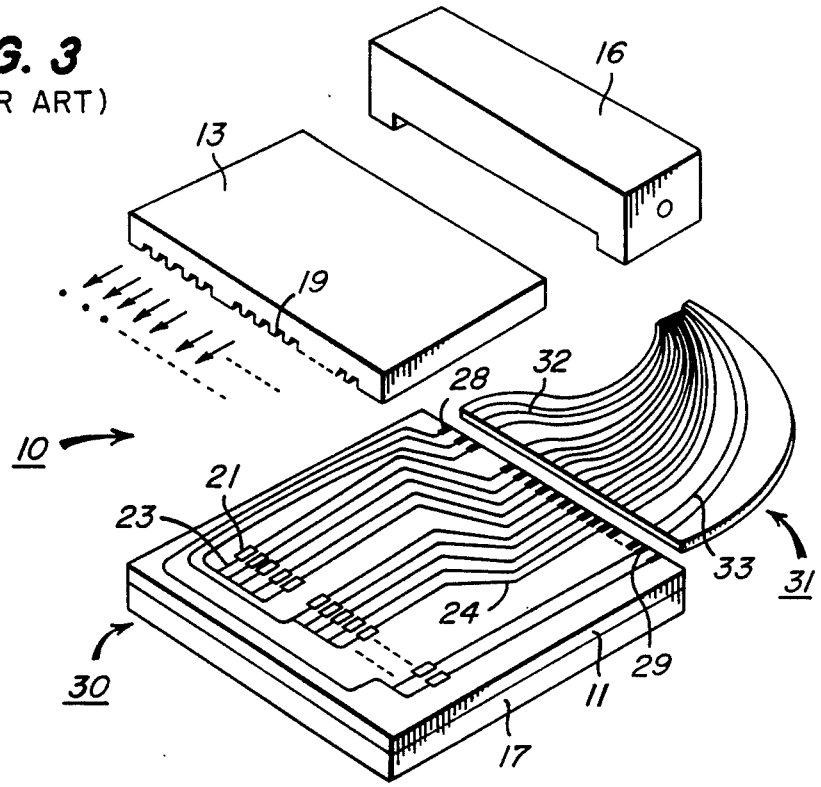
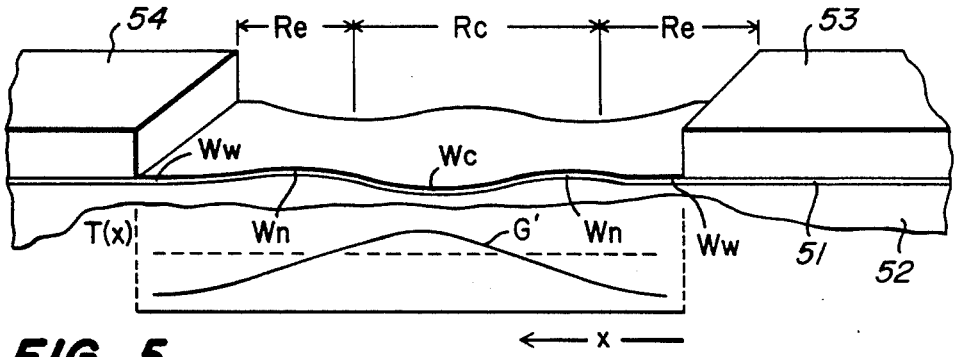
FIG. 5
FIG. 11
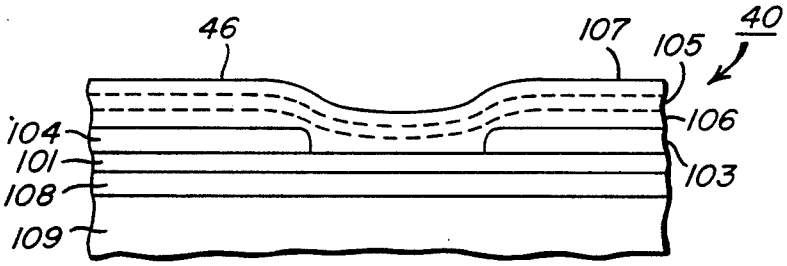

FIG. 6
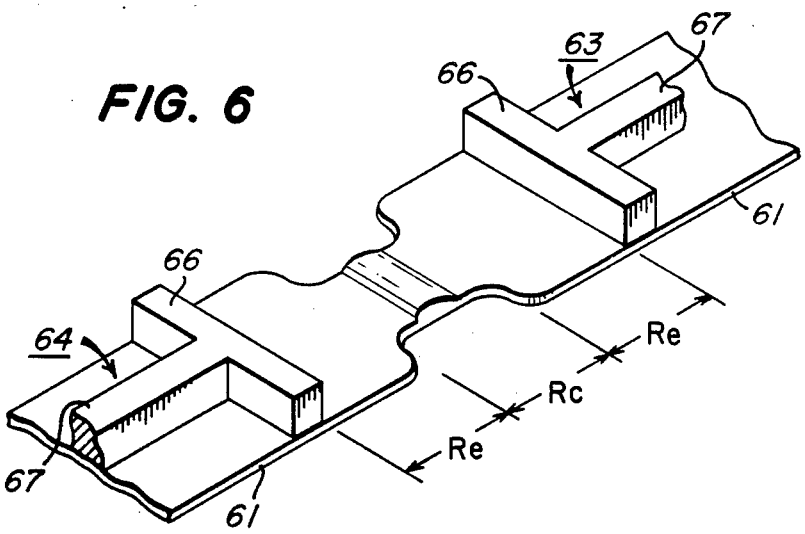
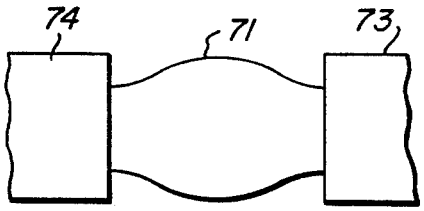
FIG. 7
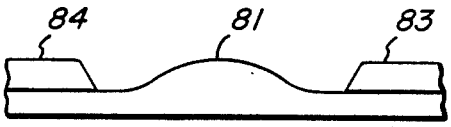
FIG. 8
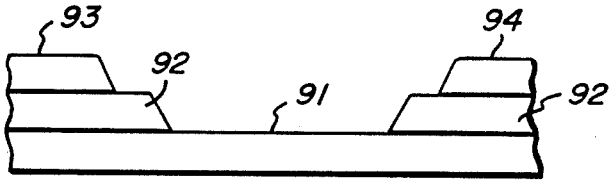
FIG. 9
FIG. 10
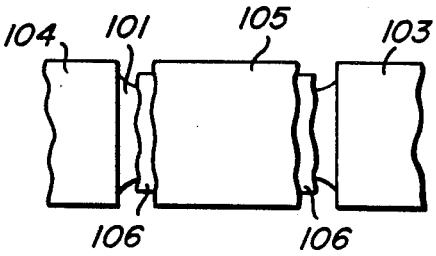

BUBBLE JET PRINT HEAD HAVING IMPROVED RESISTIVE HEATER AND ELECTRODE CONSTRUCTION

FIELD OF INVENTION

The present invention relates to thermal, drop-on-demand, ink jet print heads (herein referred to as bubble jet print heads) and, more specifically, to improved heater and electrode constructions which cooperate in such print heads to increase the useful life of the print head.

BACKGROUND ART

Typically, in bubble jet print heads a plurality of electrically resistive heater elements are deposited on a support substrate, that is formed e.g. of metal or ceramic material and has a heat control coating e.g. $SiO_2$. Metal electrodes are formed to selectively apply voltage across the heater elements and a protective coating is provided over the heater elements and electrodes. Printing ink is supplied between the heater elements and orifices of the print head and heater elements are selectively energized to a temperature that converts the adjacent ink to steam rapidly, so that a shock wave causes ejection of ink from the related orifice.

This ink jet printing approach is becoming increasingly useful; however, a major problem still exists in providing print heads wherein the heater elements are capable of a long operative life, particularly when used in high speed printing modes. Primarily, this is because protecting the drop ejectors from physical and chemical damage still presents a major technical problem.

Various protective cover constructions have been developed to isolate the print ink from the heating resistor and electrode elements of the print head and to protect those elements from physical and electrolytic damage. However, it would be desirable to further extend the life of the print heads and/or enable higher operating print speeds with those devices.

We have found that significant failure modes occur because of cracking of the heat resistor films and/or crazing of their protective cover layer(s), which can allow the commencement of electrolytic attack on the composite structures.

SUMMARY OF INVENTION

A significant purpose of the present invention is to provide, for bubble jet print heads, resistive heating element and cooperative energizing electrode constructions that increase the useful life of the print head component by controlling the temperature gradient along the energizing current path during drop ejection actuations of the print head. The present invention provides specific advantage in reducing cracking and crazing of the heater/electrode construction (and of their protective coverings) that are incident to steep thermal gradients. The present invention is also advantageous in fabricating print heads to meet specific design parameters.

In general, the present invention constitutes for a bubble jet print head of the kind having a substrate bearing a plurality of discrete ink heater elements and a plurality of address and reference electrode pairs formed of electrically conductive material and that electrically contact opposing edge regions of respective heater elements, an improved heater element and electrode construction wherein the heater elements and the electrodes exhibit in a drop ejection condition, a more uniform temperature profile (and lower temperature gradient) along the direction of current flow through the bubble formation zone.

In one preferred embodiment, a heater element is constructed to have a resistance that first increases and then decreases gradually from opposite edge regions to its center in an approximately symmetrical pattern, and the electrodes are coupled to such opposite edge regions of said heater elements.

BRIEF DESCRIPTION OF DRAWINGS

The subsequent description of preferred embodiments refers to the accompanying drawings wherein:

FIG. 1 is a cross-sectional view showing one type of prior art bubble jet print head in which the present invention is useful;

FIG. 2 is a perspective view, partially in cross-section, showing another type of prior art bubble jet print head in which the present invention is useful;

FIG. 3 is an exploded perspective view of the FIG. 1 print head;

FIG. 4 is a enlarged schematic diagram showing portions of exemplary prior art heat elements/electrodes constructions together with a typical temperature profile plot as occurs during its drop ejection operation;

FIG. 5 is a schematic diagram like FIG. 4 but showing the constructions of one preferred heater element/electrode embodiment in accord with the present invention and its related operational temperature profile plot;

FIG. 6 is a perspective view showing schematically, another heater/electrode embodiment in accord with the present invention;

FIGS. 7–10 are diagrams illustrating other modified embodiments of the present invention; and FIG. 11 is an enlarged cross-sectional portion of a print head illustrating, in more detail, particular drop ejection zone constructions that can be used in cooperation with the various embodiments of the present invention.

DETAILED DESCRIPTION OF PREFERRED EMBODIMENTS

Referring to FIG. 1 the prior art bubble jet head 10 comprises in general, a base substrate 11 formed of thermally conductive material, such as metal or glass, on which is coated a heat control layer 12 such as $SiO_2$ and a grooved top plate 13, which defines a plurality of ink supply channels 14 leading from an ink supply reservoir 15 formed by a top end cap 16. A heat sink portion 17 can be provided on the lower surface of substrate 11 if the characteristics of that substrate warrant. Located upstream from the orifices 19, formed between the grooves of top plate 13 and substrate 11, are a plurality of selectively addressable electro-thermal transducers. These transducers each comprise a discrete resistive heater portion 21, formed e.g. of $Z_rBr_2$, and a discrete address electrode 22 formed e.g. of aluminum. A common electrode 23 can be coupled to the edge of each heater element opposite its address electrode. The electrodes and heater elements can be formed on the surface of layer 12 by various metal deposition techniques.

Formed over both the electrodes and heater elements is a protective layer(s), e.g. of $SiO_2$, intended to meet the various requirements described in the background section above. Upon activation an electrical potential is created between an address electrode 22 and common electrode 23 and current flows through the resistive heater element 21. The heat provided by element 21 vaporizes the ink proximate the heater element and ejects an ink drop through orifice 19.

FIG. 2 illustrates another prior art bubble jet print head embodiment which has components similar to the FIG. 1 embodiment that are indicated by corresponding "primed" numerals. The primary difference in the FIG. 2 prior art print head is that the top plate comprises separate components 13', 13'', which cooperate to provide top ejection passages 19' and an orifice plate 19'' is provided over the passages 19'. Upon activation current passes through heater 21' between the address and common electrodes 22', 23' and ink is heated to eject a drop through the related orifice of plate 19''.

FIG. 3 shows the drop ejector component 30 of the FIG. 1 print head, with the print head top plate 13 and reservoir cap 16 removed. FIG. 3 shows how component 30 has terminal pads 28, 29 respectively coupled by common and address electrodes 23 and 24 to resistive heater elements 21. A flexible connector 31 extends from the main ink jet printer control system (not shown) and has individual connection circuits 32, 33 for engagement with terminal pads 28, 29. Thus, while the protective coating 25 (FIG. 1) desirably is over the portions of the heaters and electrodes that contact ink, it is not wanted over at least pad portions 28, 29.

Referring now to FIG. 4, we have found that in prior art print heads such as shown in FIGS. 1–3, the temperature profile in a direction x along the path of current flow through resistive heater element 21 (between electrodes 22 and 23) rises sharply from the electrode ends to the center of the heater element. Thus, it can be seen by temperature profile plot G that at the end of a drop ejection energy pulse, the temperature profile increases steeply from a level below the critical temperature $T_c$ required to form a vapor bubble to a temperature peak (substantially above $T_c$) at the center portion of the resistive heater element. This high temperature differentials (i.e. temperature gradient) in the center portion of element 21 can cause physical damage because they cause rapid, and repeated, expansion and contraction differences in the different portions of the material forming layer 21. Similar damage can occur to protective cover layers (such as shown at 25 in FIG. 1), which are in intimate contact with the heater element and therefore exhibit similar temperature gradient. Cracks in the heater element cause nonuniform current densities and promote further failure of the element integrity. Crazing in the protective cover layer promotes electrolytic attack of the heater.

We have discovered that a significant amount of print head failure relates to the extreme temperature gradient discussed above and that a major factor causing such a gradient is the heat sink effect of the address and reference electrodes. This is not readily apparent, for on first impression, a bubble jet heater appears to be a square or rectangular hot plate in which most of the generated heat flows into the support substrate and ink. That is, one assumes the heat flow to be largely normal to the plane of the resistor. However, for small, generally square shape resistors, this is not true, because the electrodes coupled to the resistive heating elements are roughly 100 times as conductive as the support substrate or the ink. More specifically, the lateral surfaces of the heating element, at which the electrodes connect, is of the order of 1/100 that of the major surface of the heating element, when the resistor is 50 μm square. In fact, the ratio of such lateral surface to the major heating surface is approximately 1/S, where S is the length of one side of the square heating element. Hence, as the resistor size decreases the loss to the sides relative to the loss perpendicular to the resistor surface increases at a rate of 1/S. This relation makes smaller heat elements less efficient and also causes them to have the center temperatures that overshoot the critical bubble formation temperature.

The present invention provides improved constructions for heaters and electrodes which are useful for reducing drop ejector component failures incident to the prior art devices radical temperature gradient at locations along the length of their current path through their heating element. FIG. 5 shows one preferred embodiment of heat element and electrodes construction for implementing this approach. In this embodiment a resistive heater layer 51 is deposited in a predetermined configuration on a substrate 52 (or heat control layer of such substrate), and address and reference electrodes 53, 54 are predeterminedly formed atop heater layer 51. More specifically, the ends of electrodes 53, 54 define the ingress and egress of a current flow path through that portion of layer 51 which is exposed between the electrode ends. Moreover, those electrode ends are each spaced with a predetermined offset from the central region Rc of the resistive heater layer 51, which defines the bubble formation zone of the heater element. Thus, the resistive heater layer 51 has two end regions Re that serve essentially as lead extensions from the electrodes 53, 54 to the edge boundaries of the bubble formation region Rc. The region Rc is sized and located relative to its related drop orifice (not shown); and as in prior art devices, both electrodes 53, 54 and resistive heater layer are covered with a protective covering (not shown).

Referring to the preferred configuration of the FIG. 5 heater element, it can be seen that the resistive layer 51 has a varying lateral dimension along the current path, and in particular that it varies from a relatively wider width a location Ww (at the juncture with the electrodes) to a relatively narrower width Wn (e.g. at the commencement of bubble formation zone) and back to a relatively wider width Wc (at the center of the bubble formation zone). In this embodiment layer 51 has a constant thickness and resistivity so that the cross-sectional area, varies directly with the width and the resistance of the layer 51 varies inversely with its lateral width along its current path direction. Therefore, during energization of the heater element the current density, and thus rate of heat generation, also varies inversely with the layer width; and several important functional features of this construction pertain. First, the rate of heat generation in the bubble formation region Rc increases in the directions from its center to its edges. This in turn reduces the high temperature difference that is incident to heat leakage into the electrodes, and therefore flattens the gradient of plot G'.

In addition, the provision of the lead extension portions (regions Re), which gradually increase in cross-section from Wn to Ww, serve to thermally isolate the edges of the bubble formation zone from heat loss to the electrodes. Moreover, the extensions themselves have a gradient of increasing heating rate from Ww to Wn. As denoted by the plot in FIG. 5, this overall cooperation of the resistive layer shape and electrode end locations significantly moderates the temperature gradient of temperature profile plot G'. Such moderated temperature gradients in turn significantly reduces the expansion and contraction stress that drop ejection energizations place on the resistive layer.

Stated another way, since the area per unit length of the resistor is greatest at its center and reduced in a direction away from the center, the power density at the center is reduced. Since the heat flow away form the center into the conductor leads is least, the central portion tends to overheat. By decreasing the power density toward the center, this overheating is offset. There are two mechanisms by which the power density is decreased; viz: (a) by increasing the area and (b) by decreasing the current density.

FIG. 6 illustrates another preferred embodiment utilizing the approach of the present invention. In this embodiment, also, the resistive layer 61 has two lead extension regions Re that extend from the energizing electrodes, designated generally 63, 64, to a central heating region Rc. However, in this embodiment the density of current flow through region Rc is varied by increasing the thickness of the layer 61 gradually from the juncture with the lead extension portions of that layer to the center of the heating zone. Thus, the thickness at the center of region Rc is the maximum layer thickness, and yields a greater cross-sectional area, smaller current density and lesser heating rate than the lesser-thickness, designated generally at the juncture Rc-Re. Preferably, the thickness decrease from center to juncture Rc-Re is symmetrical (toward each electrode 63, 64) and gradual to provide a moderate-slope temperature gradient. In addition to the temperature equalizing effect performed by making the thermal leakage path from region Rc to the electrodes longer (and with an opposing temperature gradient), the FIG. 6 embodiment reduces the thermal mass of the electrodes. This is accomplished in the FIG. 6 structure by providing each electrode with a full-resistor-width end portions 66 and reduced-width lead strips 67. The full width portion distributes the current density into the full cross-section of layer 61 portion Re, but is constructed with the minimum thermal mass that is needed to accomplish such function.

Referring now to FIGS. 7 and 8, the diagram embodiments illustrate how temperature gradient steepness reduction, in accord with the present invention, can be accomplished without significant lead extension portions (such as Re in FIGS. 4 and 5). Thus, in FIG. 7 the resistive heater layer 71 has a width that increases directly from locations proximate the junctures with electrodes 73, 74 to the center of the bubble formation zone. In the FIG. 8 drop ejection component, the thickness of resistive heater layer 81 increases from locations relatively proximate its junctures with electrodes 83, 84 to the center of the bubble formation zone.

In the alternative embodiment shown in FIG. 9, resistive heater layer 91 is coupled to electrodes 93, 94 by means of a layers 92, that have a resistivity lower than that of layer 91. Since, the first resistor layer 91 is of higher resistivity than the second 92, the temperature rise in layer 92 is much slower than in layer 91. Having a lower temperature layer between the electrodes 93, 94 and the resistor layer 91 reduces the heat flow from the resistor layer 91 into the those electrodes. This aids in reducing the thermal gradient steepness. This construction also raises the temperature of the area surrounding the central portion of resistor 91 and thereby further assists in moderating the thermal gradient.

FIGS. 10 and 11 show an embodiment of the present invention wherein the temperature gradient is reduced in steepness by provision of a highly thermally conductive layer 105 atop the resistor 101. Referring in particular to FIG. 11, the layer 105 can be electrically isolated from the electrodes 103, 104 by dielectric passivation layer 106, and if desired, covered from ink attack by layer 107. Thus, the resistive heater layer formed on heat control layer 108 of substrate 109 is protected from a central hot spot by the transfer of heat into layer 105, and its subsequent diffusion (by heat conduction) away from the bubble formation zone.

The invention has been described in detail with particular reference to certain preferred embodiments thereof, but it will be understood that variations and modifications can be effected within the spirit and scope of the invention.

We claim:

1. In a bubble jet print head of the kind having ink drop ejection assemblies including heater elements formed of electrically resistive material and respective address and reference electrode pairs formed of electrically conductive material and having electrode ends coupled to spaced terminal regions of said heater elements, an improved drop ejector assembly construction, for reducing expansion/contraction damage, wherein said heater elements have a resistance to current flow between said electrodes that first increases and then decreases gradually from each of said terminal regions to the element midpoint between said terminal regions, whereby a moderated temperature gradient is achieved along the length of said heater elements between said terminal regions.

2. The invention defined in claim 1 wherein said heater elements have a predeterminedly varying cross-section which changes in the directions, from terminal-region-to-midpoint, from a maximum cross-section at locations proximate said electrode ends to a minimum cross-section at spaced locations defining bubble formation zone ends to an intermediate cross-section at said element midpoint.

3. The invention defined in claim 1 further comprising a thermal conductor means in heat transfer relation with the central portion of heater elements and with a thermal mass for reducing the temperature of said central portion.

4. The invention defined in claim 1 wherein said electrode each have a reduced cross-section at locations proximate their contact ends with said heater terminal regions whereby the thermal mass of said electrodes is reduced in that region to maintain higher temperatures at the terminal regions of said heater elements.

5. In a bubble jet print head of the kind having a discretely energizable drop ejector construction including: (a) an electrically resistive heater layer having a bubble forming region located intermediate address and reference terminal regions of said heater layer and (b) a pair of electrically conductive lead layers having respective lead ends coupled to said heating layer terminal regions, the improvement wherein: (i) said bubble forming region of said heating layer decreases in cross-section symmetrically from its center, in directions toward each of said terminal regions to bubble formation region edge zones and (ii) said heating layer includes lead extension portions extending, respectively, from each of said electrode ends to said bubble formation region edge zones, said lead extension portions having cross-sections greater than the layer cross-section at said bubble formation region edge zones, whereby a moderate slope temperature profile is obtained in said heater layer between said terminal regions and expansion/contraction damage is reduced.

6. The invention defined in claim 5 further comprising a thermal conductor means in heat transfer relation with the bubble forming region of heater elements and with a thermal mass for reducing the temperature of said bubble forming region.

7. The invention defined in claim 5 wherein said electrodes each have a reduced cross-section at locations proximate their contact ends with said heater terminal regions whereby the thermal mass of said electrodes is reduced to maintain higher temperature at said terminal regions of said heater elements.

* * * * *